US005325784A

United States Patent [19]

Bai et al.

[11] Patent Number: 5,325,784

[45] Date of Patent: Jul. 5, 1994

[54] ELECTRONIC FUZE PACKAGE AND METHOD

[75] Inventors: Monty W. Bai, Scottsdale; Danny E. Minks, Phoenix, both of Ariz.

[73] Assignee: Motorola, Inc., Schaumburg, Ill.

[21] Appl. No.: 11,580

[22] Filed: Feb. 1, 1993

[51] Int. Cl.[5] ..... F42C 13/04

[52] U.S. Cl. ..... 102/293; 102/214; 102/215

[58] Field of Search ..... 102/293, 214, 215, 206, 102/200

[56] References Cited

U.S. PATENT DOCUMENTS

| | | | |
|---|---|---|---|
| 3,064,194 | 11/1962 | Sreb | 102/214 |
| 3,152,547 | 10/1964 | Kyle | 102/214 |
| 4,037,540 | 7/1977 | Keydel | 102/214 |
| 4,047,485 | 9/1977 | Abt | 102/214 |
| 4,750,424 | 6/1988 | Hau | 102/293 |
| 4,826,720 | 5/1989 | Wade | 428/209 |
| 4,903,603 | 2/1990 | Longerich et al. | 102/214 |
| 4,924,152 | 5/1990 | Flickinger | 315/363 |
| 5,004,672 | 4/1991 | D'Ottavio et al. | 430/314 |
| 5,008,496 | 4/1991 | Schmidt et al. | 174/254 |
| 5,020,413 | 6/1991 | Oaks | 102/206 |

*Primary Examiner*—David H. Brown
*Attorney, Agent, or Firm*—Jeffrey D. Nehr

[57] ABSTRACT

An electronic fuze package and method includes a left casing comprising a substantially flat left surface having left casing recesses and a right casing comprising a substantially flat right surface having right casing recesses. The combination of the left casing and the right casing defines a fuze casing for the mounting of fuze components. The fuze package also includes plated-on electrical tracks on the left casing, including component connections immediately adjacent to the casing recesses for electrically coupling the fuze components in a fuze circuit. The fuze package can be made of thermoplastic left and right casings which can be epoxy-glued together. Copper can be used for the plated-on electrical tracks.

18 Claims, 3 Drawing Sheets

ELECTRONIC FUZE PACKAGE AND METHOD

FIELD OF THE INVENTION

This invention relates in general to the packaging of electronics in high acceleration and extreme temperature environments and in particular to the packaging of electronic fuzes.

BACKGROUND OF THE INVENTION

Electronics for high acceleration (high g) and extreme temperature environment applications such as projectile fuzes must survive and function both during and after launching. Modern electronic fuzes have become more complex as demands have increased for electrical as well as mechanical performance options. The increased complexity of fuze systems makes production of fuzes capable of functioning in extreme dynamic and thermal environments even more difficult. Performance reliability and high volume producibility of electronics fuze systems typically decrease as fuze system complexity increases, mainly due to failures at system levels.

A typical electronic assembly in a fuze system comprises various electronic components, including a printed wiring board (PWB), PWB support or housing, connecting wires or pins and sockets, and encapsulant. One of the most critical components of an electronic fuze is the PWB. To produce a high quality PWB which will function reliably requires time-consuming and labor-intensive processes for the steps of laminating fiberglass woven layers, drilling, cutting, adding connectors and standoffs. Most electronic components mounted to a PWB would not be able to withstand the dynamics of gun launching without a mask, PWB housing, and encapsulant material for cushioning, damping, and support of the internal components.

While encapsulant packaging techniques have generally been successful at providing such additional support in a fuze assembly under dynamic environments, such techniques can result in solder cracks and brittle component failures during military standard temperature and humidity tests (per MIL-STD-331). In addition, these encapsulant techniques are not easily controlled, are messy, and typically yield poor reproducibility, e.g., when unpredictable shrinks, cracks, or voids occur within the encapsulant.

Thus, what is needed is an apparatus for electronic fuze packaging with a higher degree of fuze system integration. Such integration is desired to eliminate the use of encapsulant material and reduce the number of components and assembly processes associated with the fuze assembly. By reducing the number of mechanical and electrical interfaces between components in an integrated fuze package, the fuze assembly will achieve a significant improvement in electrical and mechanical performance reliability, improved manufacturability, and reduction of unit cost.

SUMMARY OF THE INVENTION

An electronic fuze package is contemplated which includes a left casing comprising a substantially flat left surface having left casing recesses and a right casing comprising a substantially flat right surface having right casing recesses. The combination of the left casing and the right casing, positioned with the substantially flat left surface placed against the substantially flat right surface, defines a fuze casing having casing recesses formed from the combination of the left casing recesses and the right casing recesses, wherein the casing recesses are confined within the fuze casing for the mounting of fuze components. The fuze package also includes plated-on electrical tracks on the left casing, wherein the plated-on electrical tracks include component connections immediately adjacent to the casing recesses for electrically coupling the fuze components in a fuze circuit when the fuze components are mounted within the fuze casing.

A method for making an electronic fuze package is also contemplated which includes the steps of molding a left casing comprising a substantially flat left surface having left casing recesses and molding a right casing comprising a substantially flat right surface having right casing recesses. The combination of the left casing and the right casing, positioned with the substantially flat left surface placed against the substantially flat right surface, defines a fuze casing having casing recesses formed from the combination of the left casing recesses and the right casing recesses. The casing recesses are for the mounting of fuze components. The method further includes the step of plating on electrical tracks on the left casing, the plated-on electrical tracks including component connections immediately adjacent to the casing recesses for electrically coupling the fuze components in a fuze circuit when the fuze components are mounted within the fuze casing.

The above and other features and advantages of the present invention will be better understood from the following detailed description taken in conjunction with the accompanying drawings.

DETAILED DESCRIPTION OF THE PREFERRED EMBODIMENT

Figure 1:
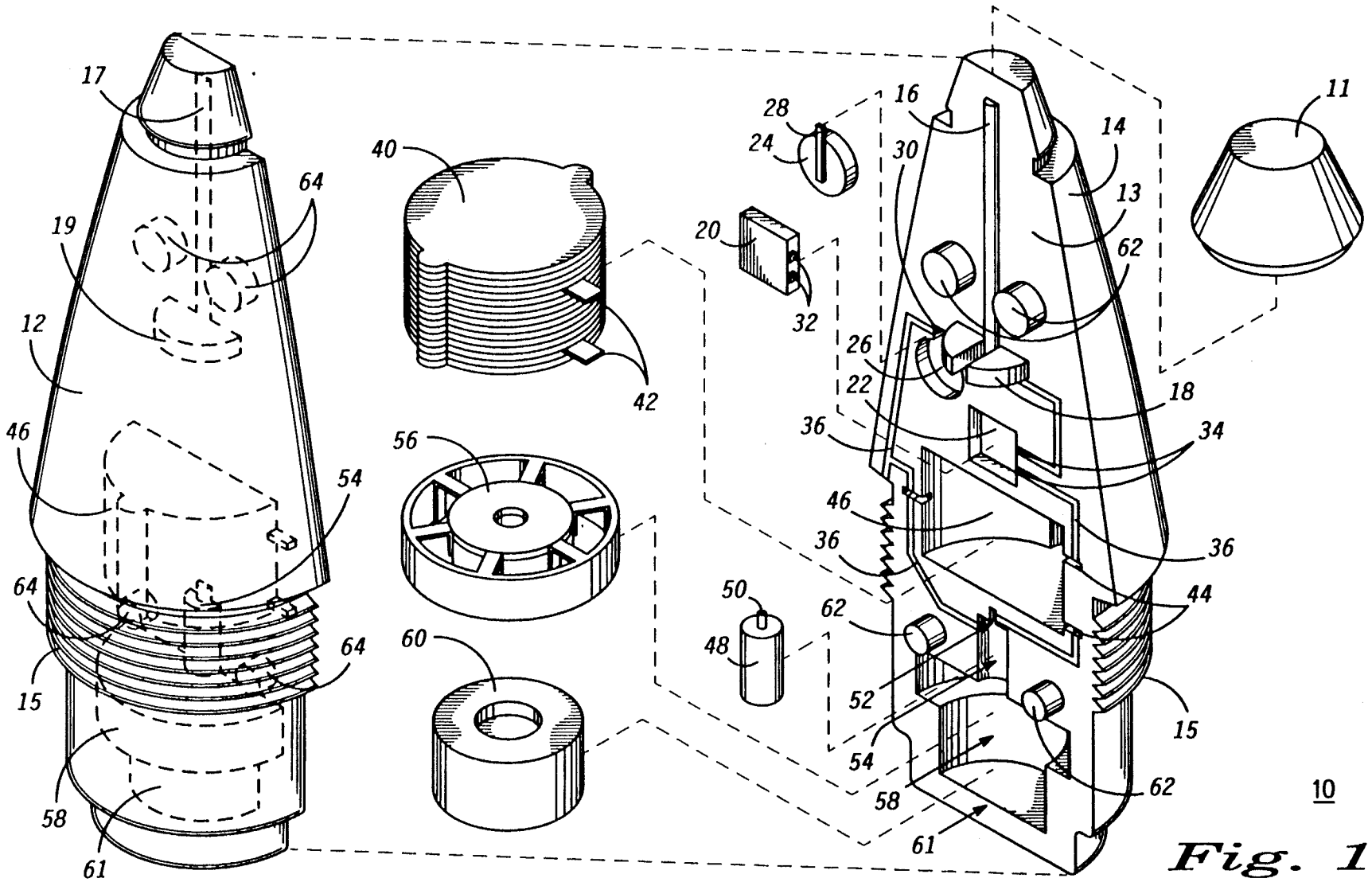
In FIG. 1, there is shown an exploded view of an electronic fuze package in accordance with a preferred embodiment of the invention.

In FIG. 1, there is shown an exploded view of an electronic fuze package 10 in accordance with a preferred embodiment of the invention. The fuze package 10 is comprised of a left casing and a right casing, referred to as left half fuze package 12 and right half fuze package 14, respectively.

Left half fuze package 12 and right half fuze package 14 are comprised of a moldable material, such as thermoplastic. The left half fuze package 12 and the right half fuze package 14, when aligned and assembled as shown in FIG. 1, form a completed nose mounted fuze package 10. The left half fuze package 12 and the right half fuze package 14 are fit together by mating corresponding substantially flat surfaces 13. Right half fuze package 14 comprises a plurality of alignment pins 62 which mate with alignment pin recesses 64 in the left half fuze package 12 when the fuze package 10 is assembled and secured (e.g., by epoxy glue).

The outer shape of the assembled fuze package 10 in FIG. 1 is a projectile shape, with the fuze package 10 in FIG. 1 illustrating a nose mounted configuration. The fuze package 10 illustrated is also suitable for body-mounted or other projectile system configurations, since the outer shape of the fuze package 10 is adaptable (moldable) to a variety of forms depending on the particular application. The precise layout of the internal components of fuze package 10 is also easily modifiable.

The threads 15 on the left half fuze package 12 and the threads 15 on the right half fuze package 14 align when the left half fuze package 12 and the right half fuze package 14 are mated during assembly. The combined threads 15 on assembled fuze package 10 can be used to secure the fuze package 10 to an explosive projectile body.

The ablation shield 11 shown in FIG. 1 is an optional addition to the nose mounted fuze package 10. The ablation shield can be placed over the tip of the nose portion of fuze package 10 and secured after all internal components have been properly positioned within the left half fuze package 12 and the right half fuze package 14 and the left half fuze package 12 and the right hand fuze package 14 have been placed together. The ablation shield may be necessary to prevent degradation of the nose mounted fuze package 10, depending on the thermoplastic or other material used in the fuze package 10 and the dynamics of the launch to which the fuze package 10 will be subjected.

Both the left half fuze package 12 and the right half fuze package 14 contain a plurality of casing recesses for the mounting of fuze components. Included within both left half fuze package 12 and right half fuze package 14 are antenna recess 17, battery mounting recess 46, detonator recess 54, safing and arming device recess 58, and detonator booster mounting recess 61. Also included in left half fuze package 12 are a plurality of alignment pin recesses 64. Also included in right half fuze package 14 are component mounting recess 26, processor mounting recess 22, and recesses for the fuze circuit track 36.

FIG. 1 shows electronic component 24, with component lead 28, to be mounted in component mounting recess 26 of the right half fuze package 14. When secured within the component mounting recess 26 (e.g., by epoxy glue), electronic component 24 can be coupled to fuze circuit track 36 via connection 30 (e.g., by wire bonding), forming part of the fuze circuit for the fuze package 10. Similarly, processor 20 in FIG. 1 can be mounted in processor mounting recess 22. When epoxy glued or otherwise secured within the processor mounting recess 22, processor leads 32 can be wire-bonded or otherwise electrically coupled to additional fuze circuit track 36 via connections 34, such that processor 20 also forms part of the fuze circuit for the fuze package 10.

Fuze circuit tracks 36 can comprise plated-on electrical tracks, e.g. copper tracks. The fuze circuit tracks can be provided within track recesses in the right half fuze package 14 so that the fuze circuit tracks 36 do not extend beyond substantially flat surface 13 of right half fuze package 14 and interfere with the mating of left half fuze package 12 and the right half fuze package 14 during assembly of fuze package 10. As an alternative, fuze circuit tracks 36 can be fabricated directly on substantially flat surface 13 of the right half fuze package 14 so long as corresponding fuze track recesses are provided within substantially flat surface 13 of the left half fuze package 12. Fuze circuit tracks 36 can also be made to extend to connect to threads 15 to create a common electrical ground connection for the fuze package 10 and the projectile body to be screwed onto the fuze package 10.

FIG. 1 illustrates additional components which are accommodated within the recesses in both left half fuze package 12 and right half fuze package 14. Antenna 16, including antenna base 18, is shown in FIG. 1 in mounted position within right half fuze package 14. Antenna recess 17 in the left half fuze package 12 accommodates those portions of antenna 16 and antenna base 18 which extend outward from right half fuze package 14 beyond substantially flat surface 13 when the left half fuze package 12 and the right half fuze package 14 are assembled. In a similar manner, battery mounting recess 46, detonator recess 54, safing and arming device recess 58, and detonator booster mounting recess 61 present in both the left half fuze package 12 and the right half fuze package 14 accommodate battery 40, detonator 48, safing and arming device 56, and detonator booster 60, respectively.

The components referred to above are mounted in the preferred embodiment with their center of mass as close as possible to the longitudinal axis of the fuze package (i.e., aligned with the launch trajectory). Symmetric mass distribution about the longitudinal (i.e., spin) axis of the projectile provides increased dynamic stability. The safing and arming device 56 is located between the detonator 48 and the detonator booster 60.

When battery 40 is inserted into battery mounting recess 46 in the right half fuze package 14, battery leads 42 contact battery connections 44. The battery connections 44 are electrically coupled to fuze circuit track 36 so that the battery 40 becomes part of the fuze circuit in fuze package 10.

The antenna 16 is coupled to the antenna base 18 which is itself coupled to the fuze circuit track 36. Thus, the antenna 16 is also part of the fuze circuit. Similarly, detonator 48 is coupled into the fuze circuit in fuze package 10. Detonator lead 50 contacts detonator connector 52 when detonator 48 is inserted within detonator mounting recess 54. The thermoplastic or other moldable material comprising the left half fuze package 12 and the right-half fuze package 14 acts as a dielectric material important for the functioning of the fuze circuit track 36 and the antenna 16.

Safing and arming device 56 can be an unwinding ribbon safing and arming device such as that described in U.S. Pat. No. 5,147,974, issued on Sept. 15, 1992 to the same assignee, the disclosure of which is hereby incorporated by reference.

The steps of assembling fuze package 10 in FIG. 1 include molding left half fuze package 12 and right half fuze package 14, plating on fuze circuit tracks 36, placing, fastening, and connecting electronic component 24 and processor 20 to fuze circuit tracks 36, mounting and connecting battery 40 and detonator 48 to fuze circuit tracks 36, mounting safing and arming device 56 and detonator booster 60, and aligning, mating and fastening (e.g. by epoxy glue) left half fuze package 12 and right half fuze package 14. Ablation shield 11 may also be attached to the nose of the fuze package 10.

When fuze package 10 is completely assembled, a fuze circuit results which comprises antenna 16, electronic component 24, processor 20, battery 40, and detonator 48 coupled by fuze circuit track 36. The fuze functions after launch of the fuze package (as part of an explosive projectile) by arming and determining the proper time to explode the detonator 48. The determination as to when the fuze circuit is to provide an electrical signal to explode the detonator is based on electromagnetic signals produced by the fuze circuit (such as microwave frequency radiation) which are transmitted by the fuze circuit antenna 16 to a target. The interaction of the electromagnetic signals with the target produces reflected signals which are received by the fuze circuit antenna 16 and processed by the fuze circuit. The processor 20, based on preprogrammed instructions and decision-making algorithms, uses information derived from the fuze circuit processing of the reflected signals and makes the determination as to when the fuze circuit produces the electrical signal to explode the detonator 48 (and thereby the detonator booster and adjacent explosives within the projectile).

Figure 2:
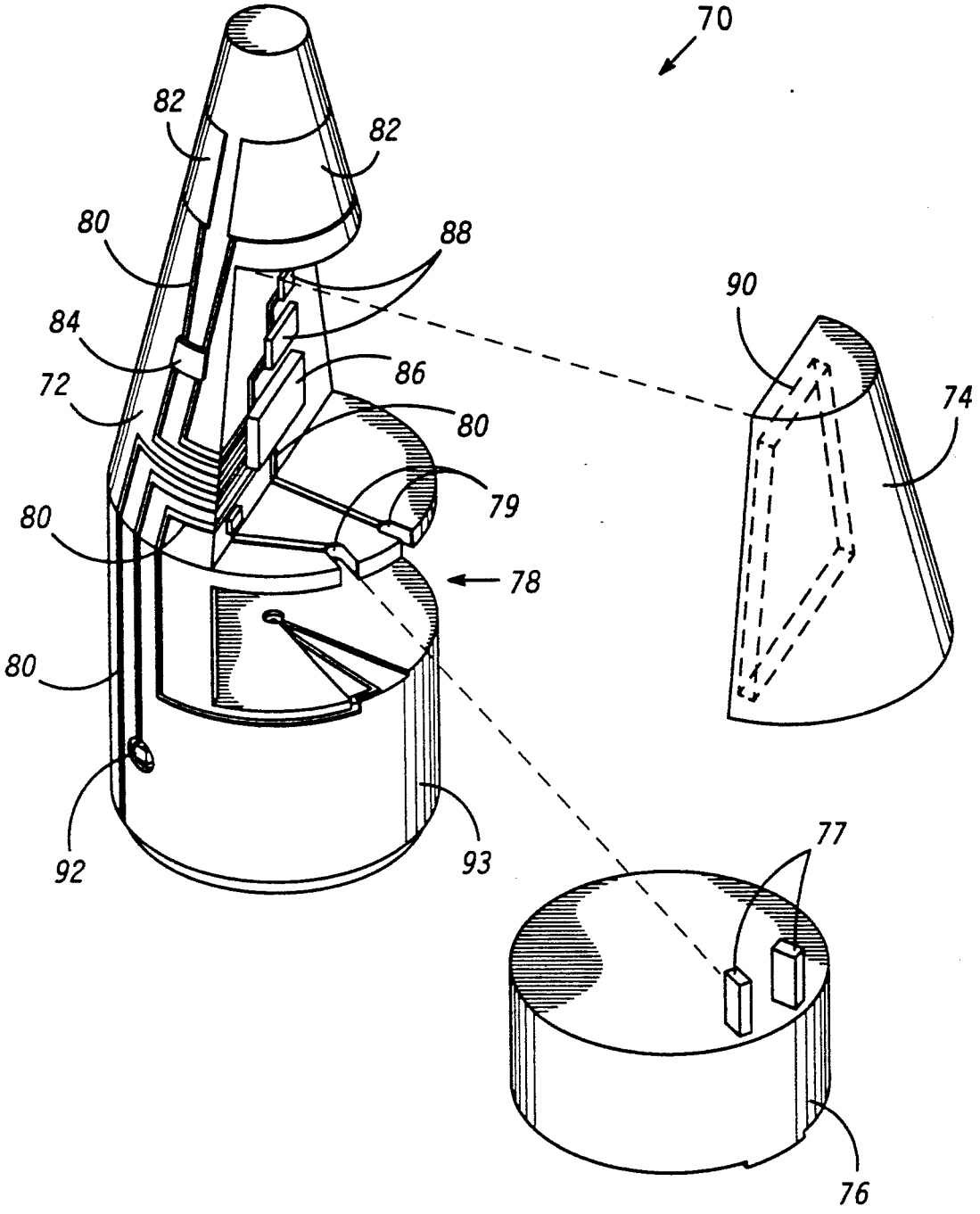
In FIG. 2, there is shown an exploded view of a second electronic fuze package in accordance with a second preferred embodiment of the invention.

In FIG. 2, there is shown an exploded view of a second electronic fuze package in accordance with a second preferred embodiment of the invention. Fuze package 70 comprises left fuze package portion 72 and right fuze package portion 74, as well as battery 76.

Left fuze package portion 72 can be comprised of a moldable material, such as thermoplastic, and includes antenna 82, monolithic microwave integrated circuit (MMIC) 84, electronic component 88, integrated circuit microprocessor 86, battery contact connections 79, and circuit test point 92. Each of the components of left fuze package portion 72 is coupled in an electrical circuit by fuze circuit track 80. The fuze circuit track 80 can be plated-on metal such as copper, and forms a three-dimensional molded circuit board arrangement in conjunction with the remaining fuze circuit components. For example, antenna 82 can be formed as an extension of portions of the fuze circuit track 80 with extended plated on areas, as shown in FIG. 2. The left fuze package portion 72 material acts as a dielectric necessary for the functioning of the fuze circuit track 80 and the antenna 82.

The left fuze package portion 72 also comprises battery mounting recess 78, which accommodates the battery 76 when the entire fuze package 70 is assembled. Battery contacts 77 on the battery 76 mate with battery contact connections 79, connecting the battery 76 to the fuze circuit track 80.

The right fuze package portion 74 also is comprised of moldable material, such as thermoplastic, and includes a recess for components 90. Recess for components 90 is a "hollowed out" portion of right fuze package portion 74 which accommodates the electronic component 88, the microprocessor 86, and associated fuze circuit track 80 when the right fuze package portion 74 is mated with the left fuze package portion. The left fuze package portion 72 and the right fuze package portion 74 can be secured during assembly with epoxy glue, or by other suitable means.

Figure 3:
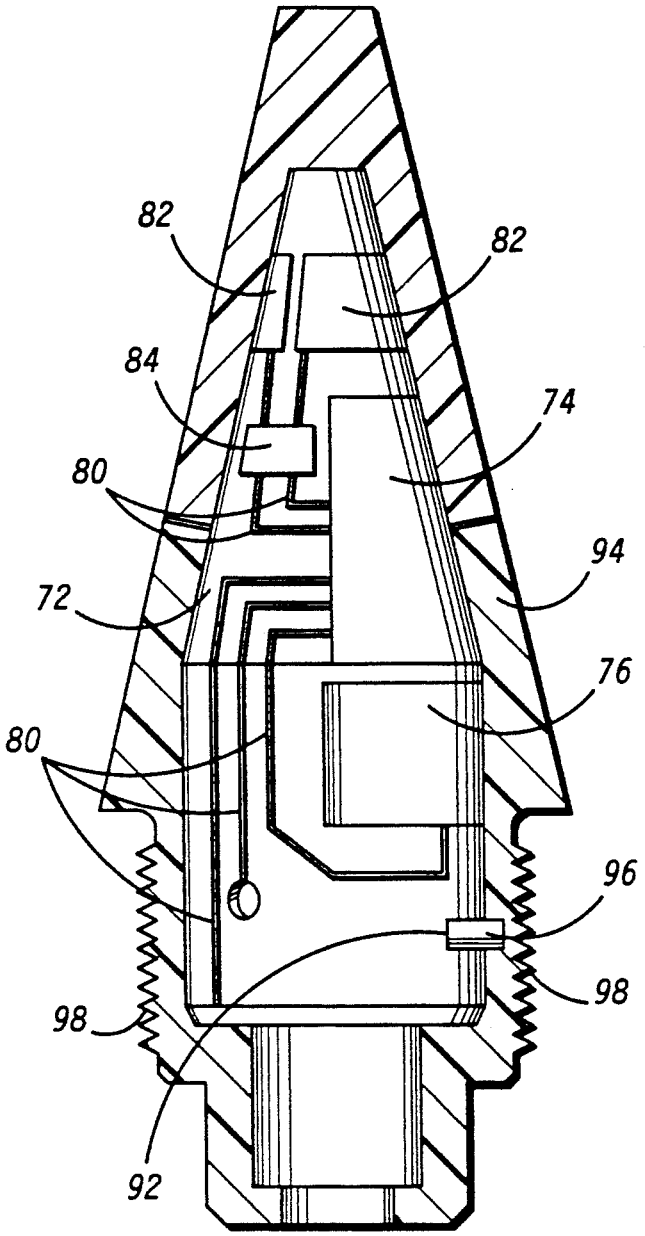
In FIG. 3, there is shown a cutaway view of the electronic fuze package of FIG. 2 mounted in a fuze casing.

In FIG. 3, there is shown a cutaway view of the electronic fuze package of FIG. 2 mounted in a fuze package case 94. The fuze package case can be formed in two longitudinal half sections which can be placed around fuze package 70 for assembly. The two sections can be fastened together, e.g. by epoxy, encasing the fuze package 70.

Fuze package case 94 comprises a case access hole 96, which allows access to test point 92 of the fuze circuit in FIG. 2. Thus, the case access hole 96 allows access to a fuze circuit test point for testing of the electronic fuze circuit within fuze package 70 after assembly within the fuze package case 94. Threads 98 in the fuze package case 94 provide a convenient method of assembling the fuze package case to an explosive projectile. FIG. 3 shows the case access hole 96 in the threads 98 of the fuze package case 94. Positioning the case access hole 96 in the threads 98 allows the portion of the explosive projectile which screws onto the case threads to cover the case access hole 96, so that the case access hole 96 is not exposed in the combination fuze package casing 94 and explosive projectile as finally assembled.

Thus, an electronic fuze package and method has been described which overcomes specific problems and accomplishes certain advantages relative to prior art methods and mechanisms. The improvements over known technology are significant. The use of encapsulant material can be eliminated. Internal component support occurs as a result of use of three-dimensional PWB technology. The use of plated-on circuitry on a moldable substrate which also serves as the fuze package housing eliminates components and their associated interfaces and improves the strength, manufacturability, and reliability of the final fuze package. A significant reduction in per unit cost also results. In addition, a molded electronic fuze package can be inspected internally via low-energy x-rays.

Thus, there has also been provided, in accordance with an embodiment of the invention, an electronic fuze package and method that fully satisfies the aims and advantages set forth above. While the invention has been described in conjunction with a specific embodiment, many alternatives, modifications, and variations will be apparent to those of ordinary skill in the art in light of the foregoing description. Accordingly, the invention is intended to embrace all such alternatives, modifications, and variations as fall within the spirit and broad scope of the appended claims.

What is claimed is:

1. An electronic fuze package comprising:

a three-dimensional molded circuit board comprising thermoplastic material and an integrated circuit microprocessor;

a circuit track antenna coupled to the three-dimensional molded circuit board; and an outer fuze casing in which the three-dimensional molded circuit board and the electrical circuit track antenna are housed.

2. An electronic fuze package as claimed in claim 1, further comprising a monolithic microwave integrated circuit (MMIC) coupled to the three-dimensional molded circuit board.

3. An electronic fuze package as claimed in claim 1, wherein the three-dimensional molded circuit board further comprises a plurality of plated-on copper circuit tracks coupled to circuit track antenna and to the integrated circuit microprocessor.

4. An electric fuze package comprising:

a left casing comprising a substantially flat left surface having a plurality of left casing recesses;

a right casing comprising a substantially flat right surface having a plurality of right casing recesses, wherein the combination of the left casing and the right casing, positioned with the substantially flat surface placed against the substantially flat right surface, defines a fuze casing having a plurality of casing recesses formed from the combination of the plurality of left casing recesses and the plurality of right casing recesses, the plurality of casing recesses confined within the fuze casing for the mounting of a plurality of fuze components; and a plurality of plated-on electrical tracks on the left casing, the plurality of plated-on electrical tracks including a plurality of component connections immediately adjacent to the plurality of casing recesses for electrically coupling the plurality of fuze components in a fuze circuit when the plurality of fuze components are mounted within the fuze casing.

5. An electric fuze package as claimed in claim 4, wherein the left casing and the right casing each comprise thermoplastic material.

6. An electric fuze package as claimed in claim 4, wherein the plurality of plated-on electrical tracks comprise copper.

7. An electronic fuze package as claimed in claim 4, further comprising an antenna mounted within an antenna recess in the fuze casing, wherein the antenna is coupled to the fuze circuit.

8. An electronic fuze package as claimed in claim 4, further comprising a processor mounted on the left casing within a processor recess in the left casing, wherein the processor is coupled to the fuze circuit via a plurality of processor connections.

9. An electronic fuze package as claimed in claim 4, further comprising a battery mounted within a battery recess in the fuze casing, wherein the battery is coupled to the fuze circuit via at least two battery connections.

10. An electric fuze package as claimed in claim 4 further comprising threads on the fuze casing.

11. An electronic fuze package as claimed in claim 10, wherein the threads are coupled to the plurality of plated tracks to provide access to an electrical ground.

12. An electronic fuze package as claimed in claim 4, further comprising a detonator mounted within a detonator recess in the fuze casing, wherein the detonator is coupled to the fuze circuit via a detonator connector.

13. An electronic fuze package as claimed in claim 12, further comprising a detonator booster mounted within a detonator booster recess in the fuze casing.

14. An electronic fuze package as claimed in claim 13, further comprising a means for safing and arming the electronic fuze, wherein the means for safing and arming is mounted within a safing and arming recess in the fuze casing and the means for safing and arming is located between the detonator and the detonator booster.

15. A method for making an electronic fuze package comprising the steps of:

molding a left casing comprising a substantially flat left surface having a plurality of left casing recesses;

molding a right casing comprising a substantially flat right surface having a plurality of right recesses, wherein the combination of the left casing and the right casing, positioned with the substantially flat left surface placed against the substantially flat right surface, defines a fuze casing having a plurality of casing recesses formed from the combination of the plurality of left casing recesses and the plurality of right casing recesses, the plurality of casing recesses for the mounting of a plurality of fuze components; and plating on a plurality of electrical tracks on the left casing, the plurality of plated-on electrical tracks including a plurality of component connections immediately adjacent to the plurality of casing recesses for electrically coupling the plurality of fuze components in a fuze circuit when the plurality of fuze components are mounted within the fuze casing.

16. A method for making an electronic fuze package as claimed in claim 15, further comprising the steps of:

mounting a battery within a battery recess in the fuze casing;

mounting a detonator within a detonator recess in the fuze casing;

mounting a detonator booster within a detonator booster recess in the fuze casing; and mounting a safing and arming device within a safing and arming recess in the fuze casing, wherein the safing and arming device is positioned between the detonator and the detonator booster.

17. A method for making an electronic fuze package as claimed in claim 15, wherein the steps of molding a left casing and molding a right casing comprise the steps of molding a left casing of thermoplastic material and molding a right casing of thermoplastic material, respectively.

18. A method for making an electronic fuze package as claimed in claim 17, further comprising the steps of:

connecting first and second battery terminals on the battery to first and second battery connections on the plurality of electrical tracks; and connecting a detonator lead on the detonator to a detonator connector on the plurality of electrical tracks.

* * * * *